US006622496B2

(12) United States Patent
Cheng et al.

(10) Patent No.: US 6,622,496 B2
(45) Date of Patent: Sep. 23, 2003

(54) EXTERNAL LOOP NONFREEZING HEAT EXCHANGER

(75) Inventors: Alan Tat Yan Cheng, Livingston, NJ (US); Donald Leonard DeVack, Norwalk, CT (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/904,023

(22) Filed: Jul. 12, 2001

(65) Prior Publication Data

US 2003/0101736 A1 Jun. 5, 2003

(51) Int. Cl.[7] ..... F25B 9/00; F17C 9/02; F25D 17/02; F25D 17/04

(52) U.S. Cl. ..... 62/86; 62/50.2; 62/118; 62/309

(58) Field of Search ..... 62/86, 97, 118, 62/121, 309, 62, 50.2

(56) References Cited

U.S. PATENT DOCUMENTS

| | | | | | |
|---|---|---|---|---|---|
| 2,309,938 | A | * | 2/1943 | Diserens et al. | 62/178 |
| 3,154,928 | A | * | 11/1964 | Harmens | 62/86 |
| 3,937,031 | A | * | 2/1976 | Cook | 62/98 |
| 4,726,195 | A | * | 2/1988 | Klee | 62/62 |
| 5,036,673 | A | * | 8/1991 | Miller et al. | 62/63 |
| 5,168,711 | A | * | 12/1992 | Moore et al. | 62/63 |
| 5,524,442 | A | * | 6/1996 | Bergman et al. | 62/86 |
| 5,577,392 | A | * | 11/1996 | Engler et al. | 62/380 |
| 6,014,864 | A | * | 1/2000 | Owen | 62/51.1 |
| 6,038,868 | A | * | 3/2000 | Pooley et al. | 62/63 |

* cited by examiner

*Primary Examiner*—William C. Doerrler
(74) *Attorney, Agent, or Firm*—Robert J. Follett

(57) ABSTRACT

This invention is directed to an external loop nonfreezing heat exchanger for cooling a heat transfer fluid with cryogenic fluid. The cryogenic fluid is first pre-vaporized with the spent cryogenic fluid. The heat transfer fluid is then cooled by the vaporized cryogenic fluid instead of the cryogenic fluid feed directly.

32 Claims, 1 Drawing Sheet

EXTERNAL LOOP NONFREEZING HEAT EXCHANGER

FIELD OF THE INVENTION

This invention is related to a process and system for cooling a heat transfer fluid. In particular, this invention is directed to an external loop nonfreezing heat exchanger for cooling a heat transfer fluid with cryogenic fluid.

BACKGROUND OF THE INVENTION

Cryogenic fluids, such as liquid nitrogen, have been used successfully in a number of low-temperature freezing operations such as food or biological materials freezing. In theory, it was recognized that a number of chemical and pharmaceutical processes also could benefit from cryogenic cooling due to the low temperature and high driving force afforded by cryogenic liquids. However, although certain cryogenic fluids can provide very high heat transfer driving force, it has limited use to cool process liquid if freezing is undesirable. Many process liquids have freezing point far above that of liquid nitrogen, which boils at −195° C. This limits the use of liquid nitrogen in cooling process fluid in low temperature chemical process because the process fluid can potentially be frozen. Freezing the process fluid in chemical operation is undesirable and can be hazardous especially if the refrigeration is used to control exothermic reactions.

Properly designed direct contact cooling can reduce the potential freezing problem. This is carried out by injecting liquid nitrogen directly into process or heat transfer fluid. Unfortunately, it is not always acceptable to customers due to various reasons. Although the emission level is very low at this type of operating conditions, some manufacturer's site may not be able to accept any additional vapor into the solvent recovery system. For very large potential cryogenic cooling process (chilling the heat transfer fluid for freeze-drying can use up to 40 TPD of liquid nitrogen), manufacturer would prefer reusing the spent nitrogen. Therefore, indirect contact cooling in a heat exchanger is a preferred choice of operation. However, the freezing potential must be eliminated.

A conventional approach to solve the above problem is to design an over sized shell and tube heat exchanger. A heat transfer fluid or reactant is pumped into the tube side under high velocity. Liquid nitrogen is either sprayed or flooded into the shell side of the heat exchanger. One problem encountered by this approach is that the heat transfer fluid may cause problems as the liquid nitrogen downloads its latent heat of vaporization on the metal surface. When ice starts to grow and propagate, the heat transfer surface will lose its thermal conductivity. The result is either a heat exchanger losing its heat transfer capacity rapidly or having the content frozen totally solid. The unit must be defrosted before it can be put back to service. For reactions or applications that require very short batch time, an over-sized heat exchanger may still function for a limited time before losing its capability.

Another approach is to mix the liquid nitrogen with room temperature nitrogen gas to reduce the refrigerant driving force and provide a cryogenic gas with a warmer temperature than the boiling point of −320° F. However, all the latent heat of vaporization is lost in the mixing process. Although this approach may avoid freezing, the heat transfer fluid can be warmed as high as one desired, the nitrogen consumption rate is normally too high to be economically acceptable. Furthermore, the cold gas mixture will lose its sensible heat very rapidly due to the cryogenic fluid's low heat capacity, making it unacceptable for a number of applications.

Yet another approach is to use a heat transfer fluid with lower freezing points to receive the refrigeration from the liquid nitrogen. The lower freezing point heat transfer fluid is then used to cool another heat transfer or process fluid to the final desired temperatures. Such a stopgap measure may prolong the batch time before total freezing occurs. It also adds substantial complexity and cost to the process.

The prior arts have also proposed a complicated scheme by cycling inlet and outlet of cryogenic flow to avoid freezing. However, freezing may still occur eventually, even with this complicated cycling operation by a sequence of valves. Subsequently, these prior arts also require recycling part of the spent nitrogen to mix with the fresh liquid nitrogen. The liquid nitrogen and the spent nitrogen gas form a cryogenic cold gas mixture as refrigerant.

A cycling flow control mechanism then force these cold gas mixture to enter the heat exchanger in the front and then reverses flow to enter from the back. Such a complicated mechanism not only add significant capital and operating cost to the process, but it also deteriorate the recirculating pattern of the spent nitrogen gas. Such complicated cycling procedures are believed to be unnecessary and counter-productive to the mixing requirements of the spent nitrogen and fresh liquid nitrogen.

U.S. Pat. No. 5,456,084 discloses the above complex cryogenic cooling system for freeze dryers at which a sequence of valves cycle the flow of cryogen between the heat exchanger inlet and outlet. Part of the spent nitrogen is recycled alternatively between the inlet and outlet to vaporize and mix with the fresh cryogen liquid. There is no prior art that teaches or suggests the amount of recycle is needed to make the system workable. Furthermore, an eductor is generally not the right type of device to recirculate the cryogenic nitrogen.

U.S. Pat. No. 5,937,655 discloses a heat exchanger that contains a series of baffles and vaporizers inside a single heat exchanger where the liquid nitrogen is vaporized directly inside a series of vaporizer tube. As the vaporized nitrogen warms up by contacting the heat transfer fluid surface, it is re-directed by the baffles to be chilled by the vaporizing liquid nitrogen. Very high thermal efficiency can be achieved without any mechanical means. A draw back of such as system is the complexity of the internal devices in that it requires the system to be custom designed and fabricated individually. The heat exchanger must be custom built.

It is, therefore, desirable to have an effective means to convert all the latent heat of vaporization of the cryogenic liquid into sensible heat. It is also the objective of this invention to develop a process at which a conventional heat exchanger can be used while having the benefits of cooling without freezing.

It was found from this invention that the alternative cyclic operation of cryogen inlet and out let is not necessary to make the heat transfer from the cryogen without freezing the process fluid. It was also found from this invention that the amount of spent nitrogen needed to recycle must be at higher than the weight of the fresh cryogenic liquid. An amount less than that will have a domino-effect in that the spent nitrogen will not be sufficient to vaporize the liquid nitrogen, which in turn will not be able to entrain sufficient spent nitrogen and so on. The complete loop must allow for high gas flow at low-pressure drop without the complicated valve switching system blocking its way.

There is a general misconception that the freezing condition in heat exchangers occur because of the cold temperature of the liquid nitrogen. Most freezing occur because the liquid nitrogen can boil and transfer its latent heat of vaporization rapidly when come in contact with a warmer surface. The latent heat of vaporization is generally more than half of all the refrigeration available from the liquid nitrogen. Therefore, a very small section can become extremely cold during the initial contact. As a result, the heat transfer coefficient of the liquid nitrogen is significantly bigger than a cryogenic cold gas at the equivalent temperatures.

It is therefore desirable to provide a system in which the direct contact design does not cause the process fluid to freeze.

SUMMARY OF THE INVENTION

This invention is directed to a process for cooling a process fluid which comprises flowing a cool mixed refrigerant in a continuous unidirectional loop comprising a) passing a pressurized cryogenic fluid in a heat exchange relationship with a recirculating gas to form a vaporized cryogenic fluid and a cooler recirculating gas respectively; b) passing the vaporized cryogenic fluid and the cooler recirculating gas through at least one gas mover to form a mixed gas refrigerant; and c) passing the cool mixed gas refrigerant to cool the process fluid.

This invention is also directed to a process for cooling a process fluid which comprises flowing a cool mixed refrigerant in a continuous unidirectional loop comprising a) passing a recirculating gas through a blower to form a pressurized recirculating gas; b) mixing a pressurized cryogenic fluid directly with the pressurized recirculating gas to form a cool mixed gas refrigerant; and c) passing the cool mixed gas refrigerant to cool the process fluid.

The process comprises passing the pressurized cryogenic gas at a higher pressure than the recirculating gas. The process has a recirculating gas with a mass flow greater than that of the cryogenic fluid. The recirculating gas vaporizes the cryogenic fluid. The cryogenic fluid is at a pressure of from about 10 to about 1000 psig.

A system for cooling a process fluid in a continuous unidirectional loop comprising a) a source of a pressurized cryogenic fluid; b) a recirculating gas; c) a heat exchanger through which the pressurized cryogenic fluid flows to form a vaporized cryogenic fluid and the recirculating gas flows to form a cooled recirculating gas; d) at least one gas mover to mix the vaporized cryogenic fluid and the cooled recirculating gas mix to form a mixed refrigerant; and e) a means to cool the process fluid through which a warm process fluid is cooled to form a cool process fluid by the mixed refrigerant which emerges as a warmed recirculating gas.

This invention is also directed to a system for cooling a process fluid comprising in a continuous unidirectional loop comprising a) a source of pressurized and vaporized cryogenic fluid; b) a recirculating gas; c) at least one blower to form a compressed recirculating gas for mixing with the pressurized cryogenic fluid to form a mixed refrigerant; and d) a means to cool the process fluid through which a warmer process fluid is cooled to form a cooled process fluid by the mixed refrigerant which emerges as a warmed recirculating gas.

DETAILED DESCRIPTION OF THE PREFERRED EMBODIMENT

To prevent the heat exchangers from freezing, this invention avoids direct contact of the liquid nitrogen with the metal surface where the process fluid is flowing. This is accomplished by boiling off the liquid nitrogen before it contacts the process fluid. Therefore, the metal surface containing the process fluid will come in contact only with the vaporized cryogenic cold gas, not the liquid nitrogen itself. Since the process fluid has a much bigger heat capacity to absorb the sensible heat from the nitrogen gas per unit volume, freezing can be avoided.

The draw back of using cold nitrogen gas in place of liquid nitrogen is the heat capacity of the nitrogen gas is very small. To transfer sufficient refrigeration, this invention uses a gas mover to create a very high one directional recirculating flow of cold cryogenic fluid in a closed loop. As used herein, a gas mover is a mixer that pressurizes a fluid flow and urges its movement in one direction. In this invention, it is preferable to use a plurality of gas movers in series. Excess nitrogen is bleed off only when the pressure inside the loop becomes excessive. The pressure drop is kept to a minimum. The high capacity recirculating loop eliminates a lot of drawbacks of the prior arts that uses cryogenic liquid or cryogenic nitrogen gas flow cooling. With high gas velocity, no complicated valves of switching the flow between inlet and outlet are necessary.

The pressurized cryogenic fluid (e.g., liquid nitrogen) provides the driving force for the high capacity-recirculating loop. The pressurized cryogenic fluid is vaporized in the process. No mechanical moving parts or switching valves are necessary. The countercurrent flow arrangement also provides excellent heat transfer efficiency.

The high recirculating rate verses the low exhaust rate is a key to this invention. This is achievable with the multiple stages gas movers, preferably in series, and a circulating loop with minimum pressure drop.

Figure 1:
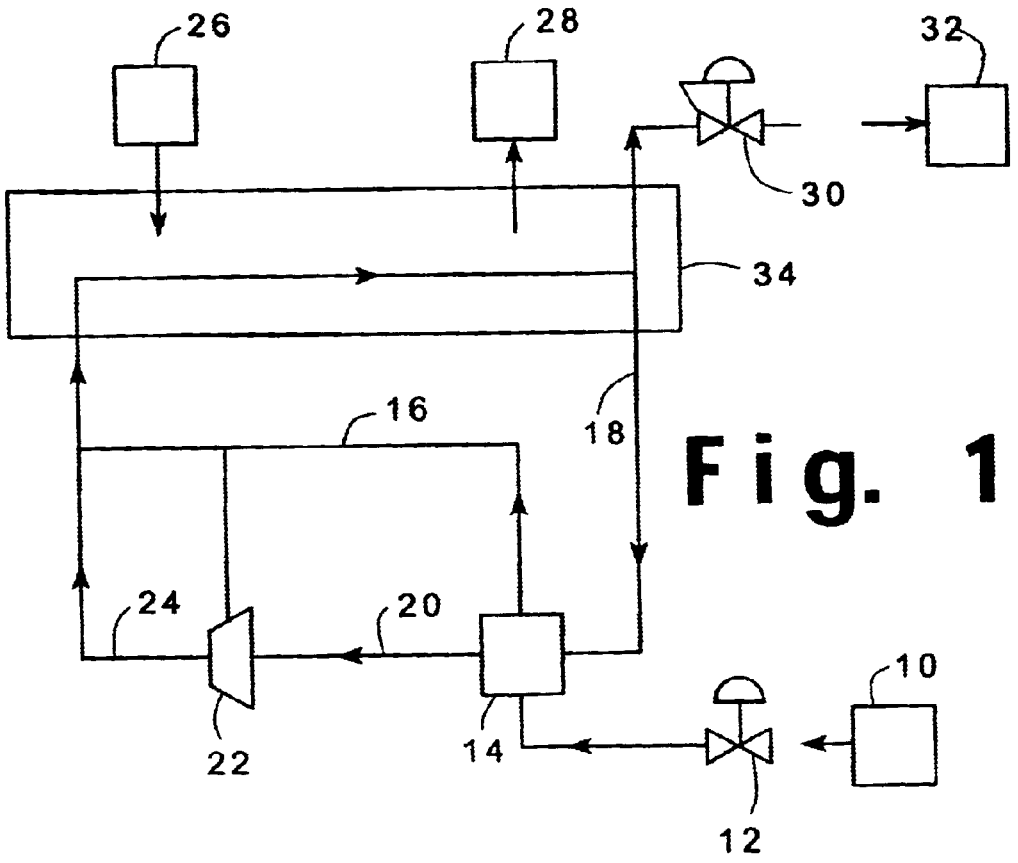
FIG. 1 is a process schematic of an external loop non-freezing heat exchanger system in this invention that uses a plate heat exchanger and a plurality of blowers.

FIG. 1 shows the general process schematic of this invention. Cryogenic fluid 10 (e.g., liquid nitrogen) enters the system at a pressure of preferably from about 10 to about 1000 psig, more preferably at from about 25 to about 300 psig, and most preferably at from about 75 to about 150 psig. The higher-pressure range is needed when the spent nitrogen is used for downstream applications. The cryogenic fluid pressure is monitored by a pressure sensor or pressure gauge (not shown).

The cryogenic fluid 10 passes through a manual valve (not shown), a solenoid valve (emergency shut off; not shown) and then control valve 12. The control valve receives the signal from a temperature controller (not shown), which monitor the temperature of the chilled heat transfer fluid (process fluid).

The cryogenic fluid then enters heat exchanger 14, preferably a plate heat exchanger, where the cryogenic fluid is boiled off (to form vaporized cryogenic gas 16) against the recirculating gas 18 (e.g., nitrogen gas)(to form cool recirculating gas 20). To transfer all the latent heat from the vaporized cryogenic gas 16 to the cool recirculating gas 20, very large volume of cool recirculating gas 20 has to be recirculated (this is the most challenging part). It is preferable to have the cryogenic fluid pass through the system at a higher pressure than the recirculating gas, preferably at a pressure at least twice that of the recirculating gas. Table 1 shows the heat and energy balance of a process at which the 1,814.5 lb/hr of nitrogen gas is being recirculated verses 769.5 lb/hr of liquid nitrogen entering the system. The nitrogen gas being recirculated is 236% of the liquid nitrogen being evaporated. Even if one consider pre-evaporating liquid nitrogen, to recirculate such a large volume of recirculating gas with much smaller amount of cryogenic fluid would be considered to be virtually physically impossible.

TABLE 1

| Stream Number | Description | Mass Flow lb/hr | Heat and mass balance Temp. C. | Pressure pisg | Latent BTU/lb | Heat flow BTU/hr | Heat Flux BTU/hr |
|---|---|---|---|---|---|---|---|
| 1 | $LN_2$ in | 769.5 | -176.2 | 79.3 | 30.49 | 23,467 | |
| 2 | $GN_2$ vapor | 769.5 | -176.2 | 78.8 | 103.08 | 79,322 | 55,855 |
| 3 | $GN_2$ mixed | 2,584.1 | -192.0 | 1.0 | 101.79 | 263,030 | |
| 4 | $GN_2$ out | 769.5 | -70.0 | 0.5 | 139.57 | 107,403 | 97,624 |
| 5 | $GN_2$ recycle | 1,814.5 | -70.0 | 0.5 | 139.57 | 253,251 | |
| 6 | $GN_2$ chilled | 1814.5 | -166.2 | 0.0 | 108.79 | 197,395 | 55,855 |
| 7 | HTF in | 29,193.5 | -53.0 | 15.0 | 17.20 | 502,145 | |
| 8 | HTF out | 29,193.5 | -60.0 | 5.0 | 20.54 | 599,770 | 97,624 |

For purposes of Table 1, $LN_2$ refers to liquid nitrogen; GN2 refers to gaseous nitrogen; and HTF refers to the heat transfer fluid (or process fluid).

The vaporized cryogenic fluid 16 (e.g., liquid nitrogen), still at its boiling point temperature (in this example, at −176° C.) enters the gas movers 22 simultaneously as several separate streams, including the cool recirculating gas 20. The pressure of the vaporized nitrogen gas provides the motive energy to move the vaporized cryogen 16 and cool recirculating gas 20 inside the gas movers 22. As an example, the high-pressure cool mixed refrigerant enters the gas blowers at the middle of the unit. There is a small gap sandwiched on the side wall. The velocity of this high-pressure cool mixed refrigerant gas increases as it passes through the small gap. Potential energy is converted into kinetic energy. The now high velocity cool recirculating gas formed exit the small gap, forming a ring of high velocity gas next to the sidewall. The close proximity of the high velocity gas stream to the side wall destroy the boundary layer and drag along the recirculating nitrogen gas in the center of the gas blower. As used herein, the terms gas movers and gas blowers may be used interchangeably.

The gas mover design is significantly different from an ejector or a thermal compressor in design and operating principles. A venturi uses a high-pressure motive gas centered at the throat of a venturi. The high pressure motive gas entering a venturi at the center of the unit is ejected to the conical part of the venturi, resulting in compression of the surrounding gases as they both squeeze through the narrow pathway of the venturi throat. Due to the small pathway of the venturi throat, the ejector or thermal compressor is suitable to increase the pressure of the entrained gas at small flow volume.

The operating principle of the ejector or thermal compressor is generally not preferred for recirculating large volumes of gases with small amounts of motive cold gases. It has been erroneously assumed that the viscosity of the gas is inversely proportional to temperature. However, the opposite is true in that the gas viscosity is proportional to temperature, opposite to the behavior of liquid. The cryogenic fluid from vaporized liquid nitrogen, however, is maintained at −320° F. For example, nitrogen gas at 80° F. will have a viscosity of 0.0715 cps. At −320° F., it decreases to 0.0055 cps. This is a 92.3% reduction in viscosity. Therefore, the viscous drag is reduced by a factor of 92.3%, which would have a direct impact on the operation of venturi type devices. Without any viscous drag, the high velocity cryogenic nitrogen gases flow through the center of flow without exchange of momentum.

Instead of injecting the cryogenic cold gas into the center of the gas stream as in an eductor or thermal compressor, the cryogenic cold gas is fed into the gas stream through a small gap on the sidewall of a gas mover. This cryogenic cold gas was then able to wrap, mix and carry a whole block of recirculating gas to move forward, despite the large drop in viscous drag.

Now, the large volume of circulating cool recirculating gas 20 (e.g., spent nitrogen) is thoroughly mixed with the freshly vaporized cryogenic gas 16 (e.g., vaporized nitrogen) to form a mixed refrigerant 24 (e.g., mixture of cryogenic cold gas). This mixture of cryogenic cold gas enters the main heat exchanger at high velocity. A shell and tube heat exchanger 34 is used with large flow tubes. This heat exchanger 34 is designed so that the pressure drop through this device is minimal to allow the recirculating flow to maintain at high velocity. To maintain such a high recirculating rate, no regulating, switches or blocking valves should be used to create pressure drop.

The high velocity of the mixed refrigerant allows the thermal boundary layer to be reduced to a minimum. The thermal boundary layer is a thin layer of relative stationary gas between the mixed refrigerant (e.g., cryogenic cold gas mixture) and the cooling surface. Since the heat capacity of this mixed refrigerant is small, the heat transfer fluid or process fluid 26 with a high heat capacity is never chilled enough to freeze. The mixed refrigerant 24 enters the process fluid heat exchanger 34. The heat exchange relationship cools the warm process fluid 26 to form cool process fluid 28. Warm recirculating gas emerges from heat exchanger 34 and continues in the continuous single directional flow pattern for another cycle. Back pressure regulator 30 controls the flow of the recirculating gas 32 for venting.

A key aspect of this invention is to prevaporizing all the cryogenic fluid into a high-pressure cryogenic cool gas. This high-pressure cool recirculating gas is used to drive a series of gas blowers to entrain more than two times its own weight of spent cryogen gas. The resulting cool recirculating gas will be recirculated in high velocity with a minimal drop in pressure. No valves or direct reversing devices are needed to avoid freezing the heat transfer fluid (or process fluid).

The main heat exchanger 34 is used for the heat transfer between the high velocity cryogenic cold gas and the heat transfer or process fluid. Alternatively, the main heat exchanger can be built of parallel plates instead of shell and tube. The gap between these plates has to be adjusted so that the pressure drop can be kept to minimum. Other types of heat exchangers such as spiral heat exchangers can also be used.

It is possible a series of specially designed venturi or eductor can also be used in place of the gas blowers. Since eductors are normally designed for steam applications, tests are necessary to properly size one or more units in order to entrain two times of its own weight of gas under cryogenic conditions.

Alternatively, electrical blowers can be used where external electrical power is used to move the large volume of spent nitrogen gas. In this case, the user has to pay for the external power. However, low-pressure liquid nitrogen can be used in this case since it will not have to work as a motive gas. Furthermore, the first heat exchanger 14 may be eliminated since the cryogenic fluid (e.g., liquid nitrogen) can be vaporized by direct mixing with the recirculating cool recirculating gas (e.g., spent nitrogen gas). This is illustrated in FIG. 2.

Figure 2:
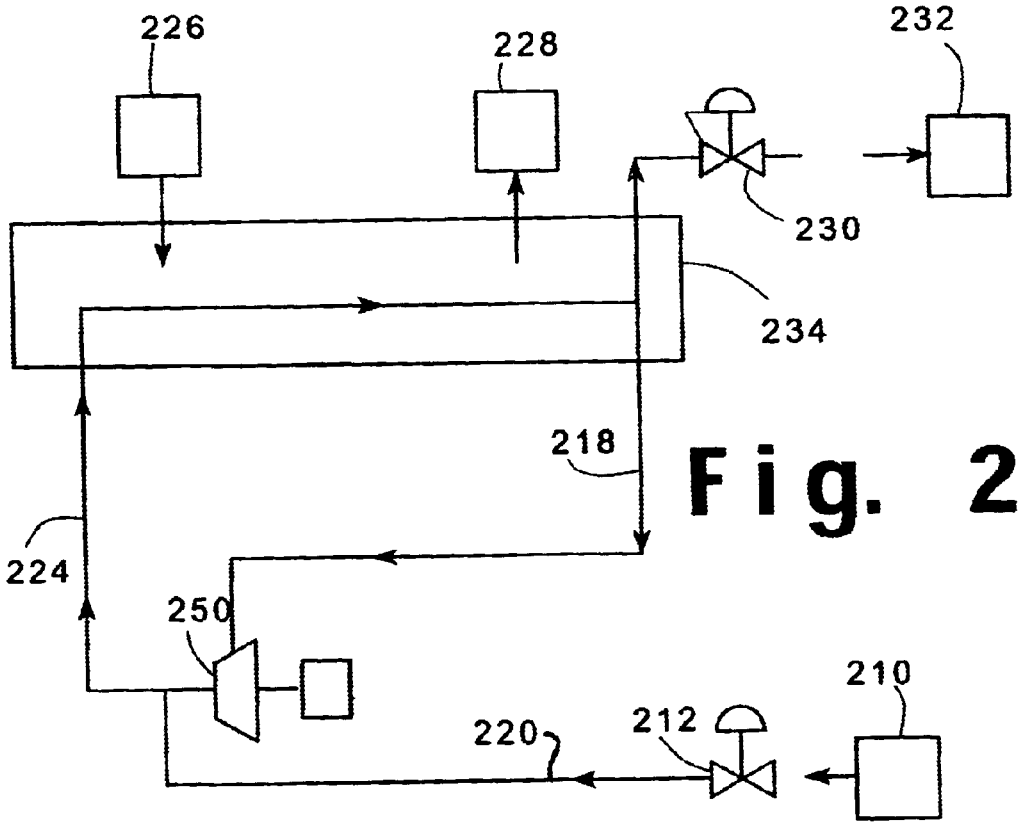
FIG. 2 is a process schematic of an external loop non-freezing heat exchanger system in this invention that uses an electrical blower.

In FIG. 2, pressurized cyrogenic fluid 210 passes through control valve 212, forming pressurized cryogenic fluid 220. Recirculating gas 218 passes through an electrical blower 250, prior to combining with the pressurized cyrogenic fluid 220 to form cool mixed refrigerant 224. Warm process fluid 226 flows through heat exchanger 234 wherein mixed refrigerant 224 effects the heat exchange relationship therein, thereby forming cool process fluid 228 (or heat transfer fluid). The resulting recirculating gas 218 is passed from the heat exchanger 234, and derived from spent mixed refrigerant 224. Back pressure regulator 230 controls the flow of the recirculating gas 232 for venting.

It should be understood that the foregoing description is only illustrative of the invention. Various alternatives and modifications can be devised by those skilled in the art without departing from the invention. Accordingly, the present invention is intended to embrace all such alternatives modifications and variances which fall within the scope of the appended claims.

What is claimed is:

1. A process for cooling a process fluid which comprises flowing a cool mixed refrigerant in a continuous unidirectional loop comprising a. passing a pressurized cryogenic fluid in a heat exchange relationship with a recirculating gas to form a vaporized cryogenic fluid and a cooler recirculating gas respectively;

b. passing the vaporized cryogenic fluid and the cooler recirculating gas through at least one gas mover to form a mixed gas refrigerant; and c. passing the cool mixed gas refrigerant to cool the process fluid.

2. The process of claim 1 which comprises passing the pressurized cryogenic gas at a higher pressure than the recirculating gas.

3. The process of claim 1 which comprises passing the pressurized cryogenic gas at a pressure of at least twice that of the recirculating gas.

4. The process of claim 1 which comprises passing the recirculating gas with a mass flow greater than that of the cryogenic fluid.

5. The process of claim 1 wherein the recirculating gas vaporizes the cryogenic fluid.

6. The process of claim 1 which comprises passing the cryogenic fluid at a pressure of from about 10 to about 1000 psig.

7. The process of claim 1 wherein the gas mover comprises a device capable of pressuring and moving the vaporized cryogenic fluid and the cooler recirculating gas to form the mixed gas refrigerant.

8. A process for cooling a process fluid which comprises flowing a cool mixed refrigerant in a continuous unidirectional loop comprising a. passing a recirculating gas through a blower to form a pressurized recirculating gas;

b. mixing a pressurized, vaporized cryogenic fluid directly with the pressurized recirculating gas to form a cool mixed gas refrigerant; and c. passing the cool mixed gas refrigerant to cool the process fluid.

9. The process of claim 8 which comprises passing the pressurized cryogenic gas at a higher pressure than the recirculating gas.

10. The process of claim 8 which comprises passing the recirculating gas with a mass flow greater than that of the cryogenic fluid.

11. The process of claim 8 wherein the recirculating gas vaporizes the cryogenic fluid.

12. The process of claim 8 which comprises passing the cryogenic fluid at a pressure of from about 10 to about 1000 psig.

13. The process of claim 8 wherein said blower comprises an electrical blower capable of flowing said recirculating gas.

14. A system for cooling a process fluid in a continuous unidirectional loop comprising a. a source of a pressurized cryogenic fluid;

b. a recirculating gas;

c. a heat exchanger through which the pressurized cryogenic fluid flows to form a vaporized cryogenic fluid and the recirculating gas flows to form a cooled recirculating gas;

d. at least one gas mover to mix the vaporized cryogenic fluid and the cooled recirculating gas mix to form a mixed refrigerant; and e. a means to cool the process fluid through which a warm process fluid is cooled to form a cool process fluid by the mixed refrigerant which emerges as a warmed recirculating gas.

15. The system of claim 14 further comprising a vent to remove excess recirculating gas.

16. The system of claim 14 further comprising a back pressure regulator to regulate the flow of recirculating gas to vent.

17. The system of claim 14 further comprising a control valve to regulate the flow of pressurized cryogenic fluid.

18. The system of claim 14 wherein the pressurized cryogenic gas is at a higher pressure than the recirculating gas.

19. The system of claim 18 wherein the pressurized cryogenic gas is at least twice the pressure of the recirculating gas.

20. The system of claim 14 wherein the mass flow of the recirculating gas is greater than the mass flow of the cryogenic fluid.

21. The system of claim 14 wherein the recirculating gas vaporizes the cryogenic fluid.

22. The system of claim 14 wherein the pressure of the cryogenic fluid is from about 10 to about 1000 psig.

23. The system of claim 14 wherein said gas mover comprises a device capable of pressuring and moving the vaporized cryogenic fluid and the cooler recirculating gas to form the mixed gas refrigerant.

24. A system for cooling a process fluid comprising in a continuous unidirectional loop comprising a. a source of pressurized and vaporized cryogenic fluid;

b. a recirculating gas;

c. at least one blower to form a compressed recirculating gas for mixing with the pressurized cryogenic fluid to form a mixed refrigerant; and d. a means to cool the process fluid through which a warmer process fluid is cooled to form a cooled process fluid by the mixed refrigerant which emerges as a warmed recirculating gas.

25. The system of claim 24 further comprising a vent to remove excess recirculating gas.

26. The system of claim 24 further comprising a back pressure regulator to regulate the flow of recirculating gas to vent.

27. The system of claim 24 further comprising a control valve to regulate the flow of pressurized cryogenic fluid.

28. The system of claim 24 wherein the pressurized cryogenic fluid is at a higher pressure than the recirculating gas.

29. The system of claim 24 wherein the mass flow of the recirculating gas is greater than the mass flow of the cryogenic fluid.

30. The system of claim 24 wherein the recirculating gas vaporizes the cryogenic fluid.

31. The system of claim 24 wherein the pressure of the cryogentic fluid is from about 10 to about 1000 psig.

32. The system of claim 24 wherein said blower comprise an electrical blower capable of pressurizing and flowing said recirculating gas.

* * * * *